US008157357B2

(12) United States Patent
Sasaki

(10) Patent No.: US 8,157,357 B2
(45) Date of Patent: Apr. 17, 2012

(54) CIRCUIT SUBSTRATE AND LIQUID DISCHARGING APPARATUS WITH A FIRST WIRING LAYER DIRECTLY CONNECTED TO THE SUBSTRATE AND A SECOND WIRING LAYER CONNECTED TO THE FIRST WIRING LAYER THROUGH A METAL FILM

(75) Inventor: Keiichi Sasaki, Oita (JP)

(73) Assignee: Canon Kabushiki Kaisha, Tokyo (JP)

( * ) Notice: Subject to any disclaimer, the term of this patent is extended or adjusted under 35 U.S.C. 154(b) by 424 days.

(21) Appl. No.: 12/429,517

(22) Filed: Apr. 24, 2009

(65) Prior Publication Data

US 2009/0267989 A1 Oct. 29, 2009

(30) Foreign Application Priority Data

Apr. 28, 2008 (JP) ..... 2008-117098

(51) Int. Cl.
*B41J 2/05* (2006.01)

(52) U.S. Cl. ..... 347/58; 347/62; 347/57; 347/56

(58) Field of Classification Search ..... 347/20, 347/56–59, 61–65, 67, 50
See application file for complete search history.

(56) References Cited

U.S. PATENT DOCUMENTS

| | | | | |
|---|---|---|---|---|
| 5,580,468 | A * | 12/1996 | Fujikawa et al. | 216/27 |
| 6,536,877 | B2 * | 3/2003 | Miyamoto et al. | 347/58 |
| 7,134,187 | B2 * | 11/2006 | Liu et al. | 29/611 |
| 2002/0125540 | A1 | 9/2002 | Shimotsusa et al. | |

FOREIGN PATENT DOCUMENTS

JP 2002-313942 A 10/2002

* cited by examiner

*Primary Examiner* — Juanita D Jackson
(74) *Attorney, Agent, or Firm* — Fitzpatrick, Cella, Harper & Scinto

(57) ABSTRACT

The present invention provides a higher density, higher resolution, higher durability and lower cost circuit substrate. In a circuit substrate in which a circuit including: a plurality of heat generating elements in which a pair of electrodes opposing each other to form a predetermined gap is provided on a resistor 16 and a portion where a resistor layer is positioned between the electrodes is taken as a resistor portion; and first and second wiring layers 12 and 15 for energizing the pair of electrodes of each heat generating element; is mounted on a substrate 10, the substrate is formed of Si, the first wiring layer is formed of a metal material containing at least Si, the first wiring layer is electrically connected to the substrate, the second wiring layer is provided on the first wiring layer through a metal film 14 for preventing Si from diffusing and a resistor is provided over the second wiring layer.

5 Claims, 4 Drawing Sheets

CIRCUIT SUBSTRATE AND LIQUID DISCHARGING APPARATUS WITH A FIRST WIRING LAYER DIRECTLY CONNECTED TO THE SUBSTRATE AND A SECOND WIRING LAYER CONNECTED TO THE FIRST WIRING LAYER THROUGH A METAL FILM

BACKGROUND OF THE INVENTION

1. Field of the Invention

The present invention relates to a circuit substrate provided with a plurality of heat generating elements and a liquid discharging apparatus and, in particular, to a circuit substrate used for a liquid discharging apparatus in which a heat generating element converts an electric energy into a thermal energy and the heat energy is used to emit a liquid.

2. Description of the Related Art

A conventional circuit substrate is described below with an inkjet head as an example.

An inkjet recording apparatus emits ink as a minute droplet from an orifice for discharging to a recording member to record an image thereon. Theoretically, a heat generating element converts an electric energy into a heat energy and the heat energy generates a bubble in the ink. The action of the bubble causes an orifice for discharging at the tip of a liquid discharging head to emit a droplet to stick to the recording member to record an image thereon. For this reason, such a liquid discharging head has a circuit substrate including a plurality of heat generating elements for converting an electric energy into a heat energy. Specifically, as illustrated in FIG. 5, a diffusion region 301 being a source and a drain region is formed on a silicon (Si) substrate 30 and a gate electrode 302 is arranged through an insulating film, forming a transistor portion 31 being a power transistor. A first wiring layer 32 is formed on the Si substrate 30 through an insulating layer and connected to the diffusion region 301 being a source and a drain region. A third wiring layer 36 forms a pair of electrodes connected to a resistor 35. One of the pair of electrodes is connected to the first wiring layer 32 connected to the source and the drain region through a second wiring layer 34. The resistor 35 between the pair of electrodes forms a heat generating portion. The pair of electrodes and the heat generating portion of the resistor 35 form the heat generating element. The second wiring layer 34 is provided between the first and the third wiring layer 32 and 36. The first wiring layer 32 is electrically connected to the third wiring layer 36.

There are formed a protective layer (passivation) 37 for protecting the third wiring layer and the resistor 35 from the ink, a cavitation resistance film 38 for protecting the protective layer from chemical or physical damages caused by heating and an interlayer film 33.

The circuit substrate used for the liquid discharging apparatus has a plurality of the aforementioned heating generating elements with a high density to record an image. Each heating generating element is connected in series with a power transistor (the transistor portion 31 in FIG. 5) for turning on and off current flowing through the heating generating element. In addition, an orifice for discharging is formed over the circuit substrate thereby providing a liquid discharging apparatus.

In recent years, there has been demanded to reduce a pitch between the heating generating elements and to print images with a small droplet and a high density. This has demanded to miniaturize a driving circuit including a heating generating element and a power transistor. The number of wirings formed over the heating generating element needs to be increased and wiring layers need to be provided under the heating generating element.

In a case where a density among the elements is 1200 dpi in terms of realizing a high density printing, the wirings are three-layered in all. The first wiring layer uses AlSi, for example, to be connected to the diffusion region of the semiconductor substrate. The second and the third wiring layer are power source wirings for driving the heating generating elements. The power source wiring thorough which a large current flows uses a highly reliable AlCu, for example. The third wiring layer forms a pair of electrodes of the heating generating element. A relevant configuration is described in Japanese Patent Application Laid-Open No. 2002-313942.

However, for the above structure, heat from the heating generating element causes a phenomenon in which Si in the first wiring layer of AlSi makes a solid solute diffusion to the second wiring layer of AlCu. For this reason, the Si erodes Si in the Si substrate and penetrates the diffusion region (illustrated by a "penetrating through portion" in FIG. 5), which may cause a problem that leakage into the substrate occurs. The diffusion of Si to the second wiring layer causes segregation and hillock of Si, produces a crack illustrated in FIG. 5 and may cause a problem that the ink durability of the heating generating element is degraded.

The object of the present invention is to emit a droplet with high density by reducing width between the heating generating elements in the circuit substrate provided with a plurality of the heating generating elements and improve the reliability of the heating generating element.

SUMMARY OF THE INVENTION

To achieve the above object, a circuit substrate for use in a liquid discharging apparatus according to the present invention is characterized by including: a pair of electrodes disposed in opposition to each other to form a predetermined gap between the electrodes; and a resistor layer arranged at least between the electrodes, wherein a circuit including a plurality of heat generating elements generating heat by energizing between the electrodes, a first wiring layer and a second wiring layer arranged in layer over the first layer to energize between the pair of electrodes of each of the heat generating elements is provided on the substrate, in that the first wiring layer is formed from metal material containing at least a main ingredient element of the substrate, the first wiring layer is electrically connected directly to a diffusion region arranged in the substrate without through a barrier metal, the second wiring layer is electrically connected to the first wiring layer though a metal film for suppressing a diffusion of the main ingredient element of the substrate contained in the first wiring layer, and the resistor layer is arranged over the second wiring layer.

Further features of the present invention will become apparent from the following description of exemplary embodiments with reference to the attached drawings.

The accompanying drawings, which are incorporated in and constitute a part of the specification, illustrate embodiments of the invention and, together with the description, serve to explain the principles of the invention.

DESCRIPTION OF THE EMBODIMENTS

The present embodiment of the present invention is described in detail below with reference to the drawings.

(First Embodiment)

There is described below the first embodiment according to the present invention in a case where the number of the wiring layers is three.

Figure 1:
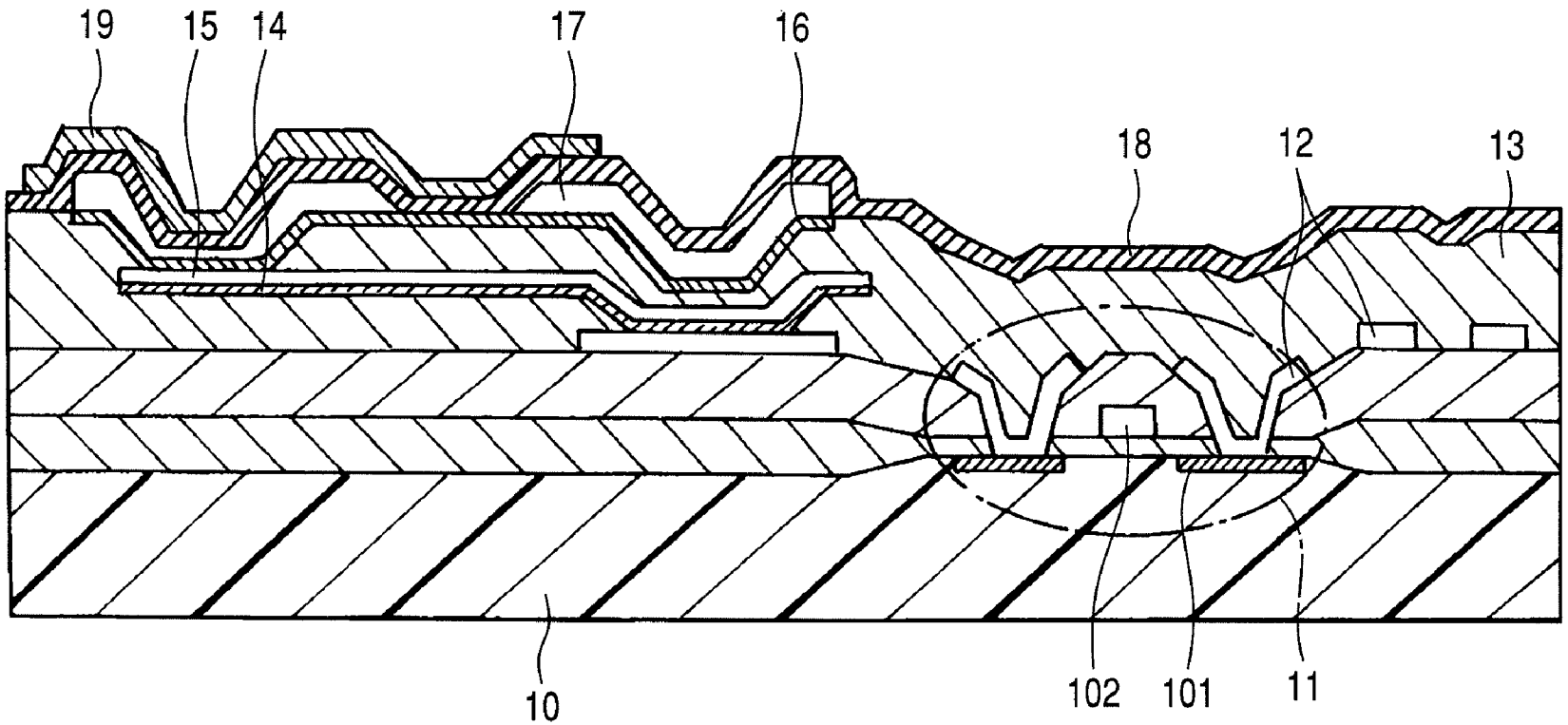
FIG. 1 is a schematic cross section illustrating a three-layered wiring structure in the first embodiment according to the present invention.

FIG. 1 is a schematic cross section illustrating a three-layered wiring structure in the first embodiment of a circuit substrate according to the present invention.

A diffusion region 101 being a source and a drain of a transistor is formed on a silicon (Si) substrate 10 and a gate electrode 102 is arranged through an insulating film, forming a transistor portion 11 being a power transistor. A DMOS may be used as the power transistor. A first wiring layer 12 is formed on the Si substrate 10 through an insulating layer and connected to the diffusion region 101 being a source and a drain region. At this point, the first wiring layer is electrically connected directly to the diffusion region without any barrier metal. A third wiring layer 17 forms a pair of electrodes connected to a resistor (resistor layer) 16. One of the pair of electrodes is connected to the first wiring layer 12 connected to the source and the drain region through a second wiring layer 15. Incidentally, the pair of electrodes may be provided separately from the third wiring layer. The pair of electrodes opposes each other to form a predetermined gap therebetween. The resistor (resistor layer) 16 between the pair of electrodes forms a heat generating portion. The pair of electrodes and the heat generating portion of the resistor 16 form a heat generating element. The second wiring layer 15 is provided between the first and the third wiring layer 12 and 17. The first wiring layer 12 is electrically connected to the third wiring layer 17. The first, the second and the third wiring layer energize the resistor 16 between the pair of electrodes of the heat generating element. The third wiring layer 17 is electrically connected to the second wiring layer 15 through an opening formed in an interlayer film 13.

Since the first wiring layer 12 is connected to the diffusion region 101, Al containing 1 at % silicon, for example, may be used to prevent erosion and spike. The second wiring layer 15 and the third wiring layer 17 are power source wirings for driving the heat generating element, so that a large current flows through the power source wirings. For this reason, Al containing 0.5 at % Cu, for example, is used to prevent electromigration. The resistor 16 for the heat generating element made of TaSiN with a sheet resistance of 200Ω, for example, is stacked under the third wiring layer 17. TaSiN (a metal film for minimizing Si diffusion) 14 is formed on the second wiring layer 15.

A part of the third wiring layer 17 of AlCu is removed to form a pair of electrodes. The resistor portion of TaSiN exposed between the pair of electrodes is a heat generating portion. The second wiring layer 15 is, for example, 300 nm in thickness. The third wiring layer 17 is, for example, 600 nm in thickness.

The interlayer film (insulating layer) 13 is arranged between the wiring layers. A silicon nitride film as a passivation layer 18 formed by plasma CVD is formed on the third wiring layer 17. A cavitation resistance film 19 of Ta with a thickness of 250 nm, for example, is formed on the silicon nitride film over the heat generating portion.

In the present structure, the TaSiN film (a metal film for minimizing Si diffusion) 14 is arranged between the first wiring layer 12 and the second wiring layer 15. This film enables the reduction of a solid solute diffusion of Si in the first wiring layer 12 to the second wiring layer 15.

Since the first wiring layer 12 uses Al containing Si, the material component in the wiring layer is prevented from eroding into Si in the diffusion region 101. The TaSiN film 14 is provided to reduce the segregation of Si and the occurrence of a hillock due to solid solution of Si in the second wiring layer. Irregularities attributed to the hillock do not occur on the second wiring layer on the heat generating portion to prevent cracks from occurring due to the deformation of the heat generating portion and prevent reliability of the heat generating portion due to variation in resistance from being lowered.

Although the TaSiN is used as a metal film for reducing the Si diffusion in the present embodiment, the metal film is not limited to the above material and other materials may be used as long as the materials have function to reduce the solid solute diffusion of Si. The materials include, for example, TaSi, TiN, Ta, TaN, CrN, CrSiN and CrSi. At least one of these materials can be used as a metal film for reducing the Si diffusion.

(Second Embodiment)

There is described a structure of the second embodiment according to the present invention in which a wiring layer is double-layered and a resistor used in a heat generating element is stacked on a second wiring layer.

Figure 2:
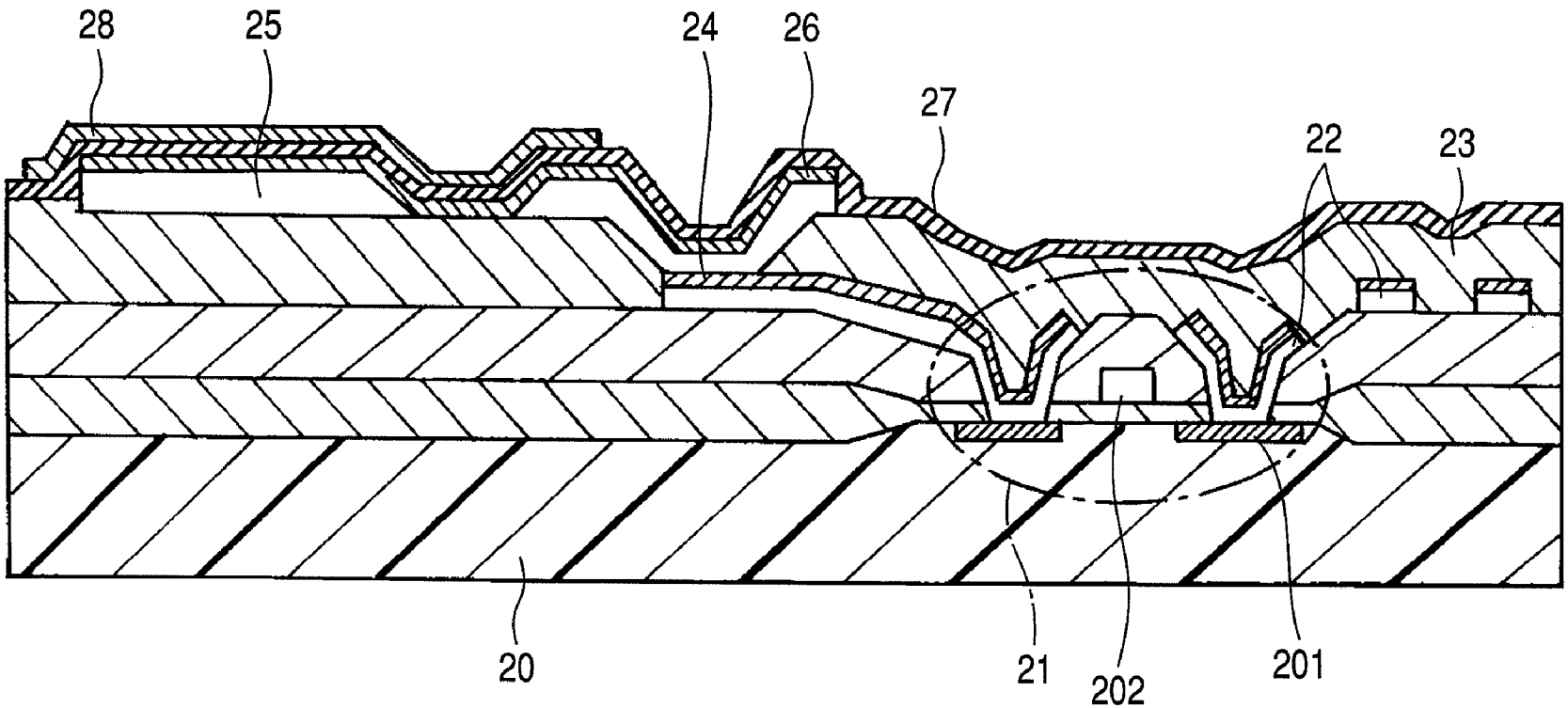
FIG. 2 is a schematic cross section illustrating a double-layered wiring structure in the second embodiment according to the present invention.

FIG. 2 is a schematic cross section illustrating a structure of a circuit substrate in the second embodiment according to the present invention.

A diffusion region 201 being a source and a drain of a transistor is formed on a silicon (Si) substrate 20 and a gate electrode 202 is arranged through an insulating film, forming a transistor portion 21 being a power transistor. A first wiring layer 22 is formed on a Si substrate 20 through an insulating layer and connected to the diffusion region 201 being a source and a drain region. A second wiring layer 25 forms a pair of electrodes connected to a resistor (resistor layer) 26. One of the pair of electrodes is connected to the first wiring layer 22. Incidentally, the pair of electrodes may be provided separately from the second wiring layer. The pair of electrodes opposes each other to form a predetermined gap therebetween. The resistor 26 is formed on the pair of electrodes. The resistor 26 between the pair of electrodes forms a heat generation portion. The pair of electrodes and the heat generating portion of the resistor 26 form a heat generating element. The first and the second wiring layer energize the resistor 26 between the pair of electrodes of the heat generating element.

Since the first wiring layer 22 is connected to the diffusion region 201, Al containing 1 at % silicon, for example, is used to prevent erosion and spike. A TiN film 24 with a thickness of 100 nm, for example, is stacked on the first wiring layer 22. The first wiring layer 22 is electrically connected to the second wiring layer 25 through the TiN film 24. The TiN film 24 functions as a metal film for preventing Si from diffusing. The second wiring layer 25 is a power source wiring for driving the heat generating element. Since a large current flows through the second wiring layer 25 being the power source wiring, the second wiring layer 25 is formed of Al containing 0.5 at % Cu, for example, to prevent electromigration and has a thickness of 1.5 μm. The resistor 26 for the heat generating element made of TaSiN with a sheet resistance of 200Ω, for example, is stacked on the second wiring layer 25. A resistor portion where the second wiring layer 25 does not exist is a heat generating portion. An interlayer film (as an insulating layer) 23 is formed between the wiring layers. A silicon nitride film with a thickness of 500 nm, for example, as a passivation film 27 formed by plasma CVD is formed over the second wiring layer 25. Incidentally, a cavitation resistance film of Ta with a thickness of 250 nm, for example, is formed on the silicon nitride film over the heat generating portion.

In the present structure, the resistor is stacked on the second wiring layer 25 to improve the coverage of the silicon nitride film, enabling the second wiring layer 25 to be thickened, which allows the number of wirings used as power source to be reduced.

In the present structure, the TiN film 24 is arranged between the first and the second wiring layers. This film enables the reduction of a solid solute diffusion of Si in the first wiring layer to the second wiring layer.

Since the first wiring layer 12 uses Al containing 1 at % silicon, the material component in the wiring layer is prevented from eroding into Si in the diffusion region 201. The TiN film 24 is provided to reduce the segregation of Si and the occurrence of a hillock due to solid solution of Si in the second wiring layer. Irregularities attributed to the hillock can be reduced on the second wiring layer to prevent cracks from occurring due to the deformation of the boundary portion between the heat generating portion and the wiring portion and prevent reliability of the heat generating portion due to variation in resistance from being lowered. Although the TiN is used as a metal film for reducing the Si diffusion in the present embodiment, the metal film is not limited to the above material and other materials may be used as long as the materials have function to reduce the solid solute diffusion of Si. The materials include, for example, TaSi, Ta, TaSiN, TaN, CrN, CrSiN and CrSi. At least one of these materials can be used as a metal film for reducing the Si diffusion.

Although Al is cited as a material for the wiring layer and as typical metal material in the foregoing embodiments, the material is not limited to Al.

(Liquid Discharging Apparatus)

A liquid discharging head using the circuit substrate according to the above embodiments can be produced such that the heat generating resistor with the heat generating resistor layer on the insulating layer of the semiconductor device according to the embodiments is formed and a member for forming an orifice for discharging such as a top plate made of molding resin and film is combined to form the orifice for discharging and a liquid path communicating therewith. A container is connected to the head, which is mounted on a printer body. Supplying the head with a power source voltage from the power source circuit of the body and image data from an image processing circuit operates an ink jet printer.

Figure 3:
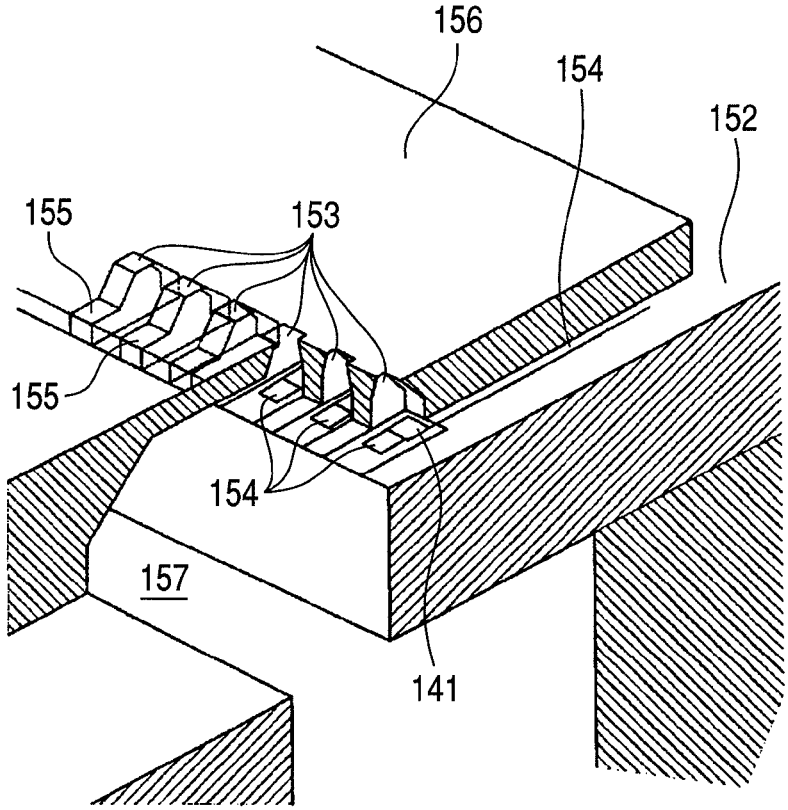
FIG. 3 is a schematic diagram describing an embodiment of the liquid discharging head according to the present invention.

FIG. 3 is a perspective view describing an embodiment of the liquid discharging head according to the present invention and illustrates a part of the liquid discharging head.

A plurality of electro-thermal converting elements (heat generating element) 141 which receives a current-flowing electric signal to generate heat and emits ink from its orifice 153 for discharging by bubbles generated by the heat is arranged in a column shape over the element substrate (circuit substrate) 152 on which the circuit described in the embodiments is fabricated. Each electro-thermal converting element is provided with a wiring electrode 154 for supplying an electric signal for driving the electro-thermal converting element. One end of the wiring electrode is electrically connected to the aforementioned transistor portions 11 and 21.

Flow paths 155 for supplying ink to the orifices 153 for discharging provided in a position opposing the electro-thermal converting element 141 are provided in opposition to respective orifices 153 for discharging. A wall forming the orifices 153 for discharging and the flow paths 155 is provided on a grooved member 156. The grooved member 156 is connected to the above element substrate 152 to provide the flow paths 155 and the common liquid chamber 157 for supplying ink to the plurality of the flow paths.

Figure 4:
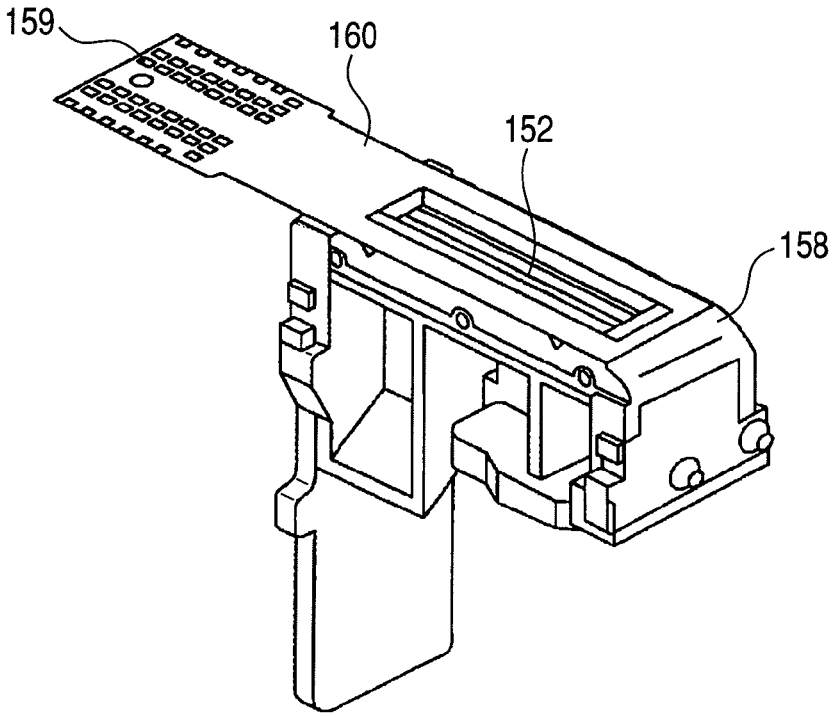
FIG. 4 is a schematic diagram illustrating the structure of the liquid discharging head in which the circuit substrate of the present invention is incorporated.
Figure 5:
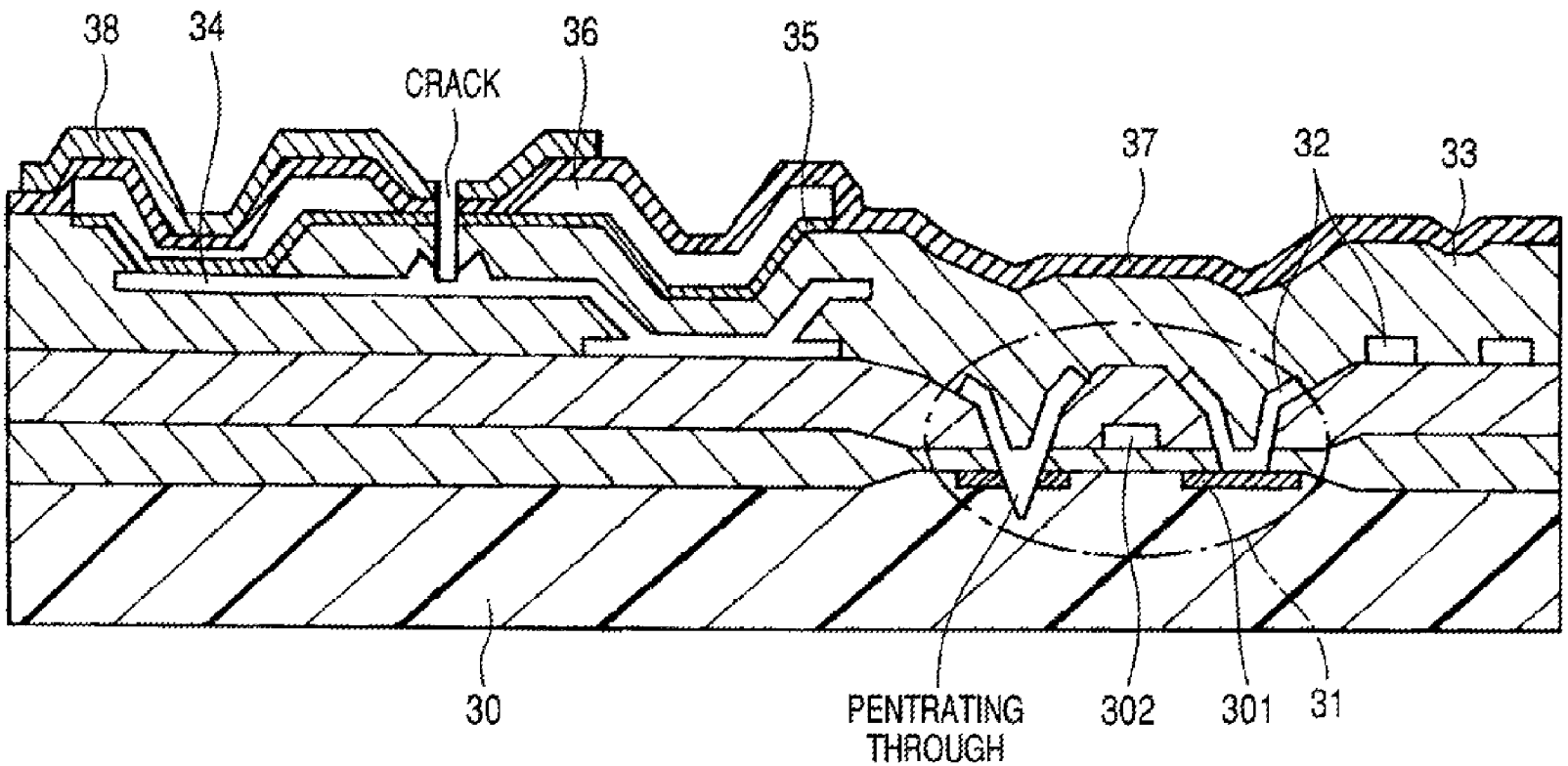
FIG. 5 PRIOR ART
FIG. 5 is a schematic diagram describing problems of a circuit substrate for a conventional liquid discharging head.

FIG. 4 is a perspective view illustrating the structure of the liquid discharging head in which the above element substrate 152 is incorporated. The element substrate 152 is incorporated in a frame 158. The grooved number 156 forming the orifices 153 for discharging and the flow paths 155 are fixed to the element substrate. A contact pad 159 for receiving an electric signal from the device is provided to supply electric signals being various driving signals to the element substrate 152 through a flexible printed wiring substrate 160 from a controller of the device body.

The circuit substrate according to the present invention is widely used in an electric appliance using a circuit substrate on which a plurality of heat generating elements is arranged and, in particular, to a circuit substrate for a liquid discharging apparatus in which electric energy is converted to heat energy by the heat generating element and liquid is emitted using the heat energy.

According to the present invention, a higher density, higher resolution, higher durability and lower cost circuit substrate can be realized.

In the present invention, although there is described a case where the main ingredient of the substrate is silicon, the ingredient is not limited to silicon. The essence of the present invention is that the lowermost wiring layer connected to the diffusion region arranged in the semiconductor substrate is formed of a metal material containing at least main ingredient of the substrate. It is characterized that the wiring layer arranged in an upper layer over the lowermost wiring layer is electrically connected to the lowermost wiring layer through a metal film for reducing the diffusion of the main ingredient of the substrate included in the lowermost wiring layer. The main ingredient refers to an ingredient accounting for 90%, for example, of the elements forming the substrate. As long as an ingredient has such a configuration, a material is not limited to a specific material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-117098, filed Apr. 28, 2008, which is hereby incorporated by reference herein in its entirety.

What is claimed is:

1. A circuit substrate for use in a liquid discharging apparatus comprising:

a pair of electrodes disposed in opposition to each other to form a gap between the electrodes; and a resistor layer arranged at least between the electrodes, wherein a circuit includes a plurality of heat generating elements generating heat by energizing between the electrodes, a first wiring layer and a second wiring layer arranged over the first layer to energize between the pair of electrodes of each of the heat generating elements, wherein the first wiring layer is formed from metal material containing at least a main ingredient element of the substrate, and wherein the first wiring layer is electrically connected directly to a diffusion region arranged in the substrate and not through a barrier metal, the second wiring layer is electrically connected to the first wiring layer through a metal film for suppressing a diffusion of the main ingredient element of the substrate contained in the first wiring layer, and the resistor layer is arranged over the second wiring layer.

2. The circuit substrate according to claim 1, wherein the substrate contains as the main ingredient element Si, the first wiring layer is formed from Al containing at least Si, the second wiring layer is formed from AlCu, the metal film for suppressing the diffusion of the main ingredient element of the substrate contained in the first wiring layer contains at least one of TaSi, TiN, Ta, TaSiN, TaN, CrN, CrSiN and CrSi.

3. The circuit substrate according to claim 1, wherein the pair of electrodes comprises a third wiring layer arranged to sandwich an insulating layer between the third wiring layer and the first and second wiring layers, and the third wiring layer is electrically connected to the first and second wiring layers through an opening formed in the insulating layer.

4. The circuit substrate according to claim 3, wherein the third wiring layer contains, as a main ingredient material Al, and the resistor layer is disposed on the third wiring layer.

5. The liquid discharging apparatus provided with the circuit substrate according to claim 1 using the heat generated by the heat generating element of the substrate for discharging a liquid comprising:

a member in which a groove is formed having an orifice for discharging the liquid and a flowing path for supplying the liquid to the heat generating element; and a power source for supplying a source voltage to the circuit substrate.

* * * * *